US007850490B2

(12) United States Patent
Hunkins

(10) Patent No.: US 7,850,490 B2
(45) Date of Patent: Dec. 14, 2010

(54) ELECTRICAL CONNECTOR, CABLE AND APPARATUS UTILIZING SAME

(75) Inventor: James D. Hunkins, Toronto (CA)

(73) Assignee: ATI Technologies ULC, Markham, Ontario (CA)

( * ) Notice: Subject to any disclaimer, the term of this patent is extended or adjusted under 35 U.S.C. 154(b) by 25 days.

(21) Appl. No.: 11/955,760

(22) Filed: Dec. 13, 2007

(65) Prior Publication Data

US 2009/0156060 A1 Jun. 18, 2009

(51) Int. Cl.
*H01R 25/00* (2006.01)

(52) U.S. Cl. ..... 439/638; 439/108

(58) Field of Classification Search ..... 439/638, 439/608, 660, 701, 707, 108
See application file for complete search history.

(56) References Cited

U.S. PATENT DOCUMENTS

| | | | | |
|---|---|---|---|---|
| 4,992,052 | A * | 2/1991 | Verhoeven | 439/62 |
| 6,130,487 | A * | 10/2000 | Bertalan et al. | 307/9.1 |
| 6,162,068 | A * | 12/2000 | Wu | 439/79 |
| 6,171,116 | B1 * | 1/2001 | Wicks et al. | 439/79 |
| 6,261,104 | B1 | 7/2001 | Leman | |
| 6,338,635 | B1 * | 1/2002 | Lee | 439/108 |
| 6,721,188 | B1 | 4/2004 | Jarvis et al. | |
| 6,811,433 | B2 * | 11/2004 | Jou | 439/541.5 |
| 6,884,116 | B2 | 4/2005 | Suzuki et al. | |
| 7,402,084 | B2 * | 7/2008 | Wu | 439/660 |
| 2006/0174047 | A1 | 8/2006 | Carty | |
| 2006/0286825 | A1 | 12/2006 | Ho | |
| 2009/0157914 | A1 | 6/2009 | Hunkins et al. | |
| 2009/0157938 | A1 | 6/2009 | Hunkins et al. | |

FOREIGN PATENT DOCUMENTS

| | | |
|---|---|---|
| EP | 1369958 A1 | 12/2003 |
| JP | 2004014350 | 1/2004 |
| TW | 226142 B | 1/2005 |

OTHER PUBLICATIONS

Allen, Danny; External PCI-Express Graphics for Laptops; from www.pcworld.com; Apr. 23, 2007; pp. 2-3.
Valich, Theo; External R600 and Crossfire cards are on the way; from www.theinquirer.net; Mar. 3, 2007; pp. 1-3.
PCI Express External Cabling Specification Revision 1.0; PCI-SIG; Jan. 4, 2007; pp. 1-142.
International Search Report from European Patent Office; for International Application No. PCT/US2008/086221; dated Mar. 5, 2009.
International Search Report from European Patent Office; for International Application No. PCT/US2008/086219; dated Mar. 23, 2009.
International Search Report from European Patent Office; for International Application No. PCT/US2008/086216; dated Apr. 24, 2009.

* cited by examiner

*Primary Examiner*—Tho D Ta
*Assistant Examiner*—Travis Chambers
(74) *Attorney, Agent, or Firm*—Vedder Price P.C.

(57) ABSTRACT

An electrical connector, such as a circuit board connector, includes a housing having therein a divided multi-connector element. The electrical connector is adapted to electrically connect with a substrate, such as a circuit board. The divided multi-connector element includes a divided electrical contact configuration that includes a first group or subassembly of electrical contacts physically separate from an adjacent and second group or subassembly of contacts. The first group of electrical contacts and second group of electrical contacts each include a row of lower contacts and upper contacts. The second group of electrical contacts has an identical but mirrored configuration as the first group of electrical contacts.

17 Claims, 23 Drawing Sheets

Host Side

606

| | Top row | | |
|---|---|---|---|
| | Pin # | "Receptacle (SMT)" | "Plug side shape" |
| | Connector shell | | |
| | T1 | CPRSNT1# | 3rd mate |
| | T2 | Opt 3.3V Return <-> | 2nd mate |
| TP0 | T3 | Dif Data PCIE+ | 3rd mate |
| TN0 | T4 | Dif Data PCIE- | 3rd mate |
| | T5 | Dif Gnd | 2nd mate |
| TP1 | T6 | Dif Data PCIE+ | 3rd mate |
| TN1 | T7 | Dif Data PCIE- | 3rd mate |
| | T8 | Dif Gnd | 2nd mate |
| TP2 | T9 | Dif Data PCIE+ | 3rd mate |
| TN2 | T10 | Dif Data PCIE- | 3rd mate |
| | T11 | Dif Gnd | 2nd mate |
| TP3 | T12 | Dif Data PCIE+ | 3rd mate |
| TN3 | T13 | Dif Data PCIE- | 3rd mate |
| | T14 | Dif Gnd | 2nd mate |
| | T15 | Opt 3.3V Power <-> | 3rd mate |
| | T16 | Opt 3.3V Power <-> | 3rd mate |
| | T17 | Opt 3.3V Power <-> | 3rd mate |
| | T18 | Opt 3.3V Power <-> | 3rd mate |
| | T19 | Dif Gnd | 2nd mate |
| TP4 | T20 | Dif Data PCIE+ | 3rd mate |
| TN4 | T21 | Dif Data PCIE- | 3rd mate |
| | T22 | Dif Gnd | 2nd mate |
| TP5 | T23 | Dif Data PCIE+ | 3rd mate |
| TN5 | T24 | Dif Data PCIE- | 3rd mate |
| | T25 | Dif Gnd | 2nd mate |
| TP6 | T26 | Dif Data PCIE+ | 3rd mate |
| TN6 | T27 | Dif Data PCIE- | 3rd mate |
| | T28 | Dif Gnd | 2nd mate |
| TP7 | T29 | Dif Data PCIE+ | 3rd mate |
| TN7 | T30 | Dif Data PCIE- | 3rd mate |

FIG. 7

604

| Bottom row | | | |
|---|---|---|---|
| Pin # | "Receptacle (Through hole)" | | "Plug side shape" |
| 1st mate | | | |
| B1 | SB_RTN | | 2nd mate |
| B2 | | Opt 3.3V Power | 3rd mate |
| B3 | | Opt 3.3V Return | 2nd mate |
| B4 | Dif Gnd | | 2nd mate |
| B5 | | Dif Data PCIE+ | 3rd mate |
| B6 | | Dif Data PCIE- | 3rd mate |
| B7 | Dif Gnd | | 2nd mate |
| B8 | | Dif Data PCIE+ | 3rd mate |
| B9 | | Dif Data PCIE- | 3rd mate |
| B10 | Dif Gnd | | 2nd mate |
| B11 | | Dif Data PCIE+ | 3rd mate |
| B12 | | Dif Data PCIE- | 3rd mate |
| B13 | Dif Gnd | | 2nd mate |
| B14 | | Dif Data PCIE+ | 3rd mate |
| B15 | | Dif Data PCIE- | 3rd mate |
| B16 | Dif Gnd | | 2nd mate |
| B17 | | Reserved2 <-> | 3rd mate |
| B18 | | Reserved3 <-> | 3rd mate |
| B19 | Dif Gnd | | 2nd mate |
| B20 | | Dif Data PCIE+ | 3rd mate |
| B21 | | Dif Data PCIE- | 3rd mate |
| B22 | Dif Gnd | | 2nd mate |
| B23 | | Dif Data PCIE+ | 3rd mate |
| B24 | | Dif Data PCIE- | 3rd mate |
| B25 | Dif Gnd | | 2nd mate |
| B26 | | Dif Data PCIE+ | 3rd mate |
| B27 | | Dif Data PCIE- | 3rd mate |
| B28 | Dif Gnd | | 2nd mate |
| B29 | | Dif Data PCIE+ | 3rd mate |
| B30 | | Dif Data PCIE- | 3rd mate |

FIG. 8

Downstream side 600

| Flat Cable | Bottom row | | | |
|---|---|---|---|---|
| | Pin # | "Plug side shape" | "Receptacle (Through hole)" | |
| | Connector shell | | | |
| ---------- | B62 | 2nd mate | | SB_RTN |
| | B61 | 3rd mate | Opt 3.3V Power | |
| | B60 | 2nd mate | Opt 3.3V Return | |
| ---------- | B59 | 2nd mate | | Dif Gnd |
| RP0 | B58 | 3rd mate | Dif Data PCIE+ | |
| RN0 | B57 | 3rd mate | Dif Data PCIE- | |
| ---------- | B56 | 2nd mate | | Dif Gnd |
| RP1 | B55 | 3rd mate | Dif Data PCIE+ | |
| RN1 | B54 | 3rd mate | Dif Data PCIE- | |
| ---------- | B53 | 2nd mate | | Dif Gnd |
| RP2 | B52 | 3rd mate | Dif Data PCIE+ | |
| RN2 | B51 | 3rd mate | Dif Data PCIE- | |
| ---------- | B50 | 2nd mate | | Dif Gnd |
| RP3 | B49 | 3rd mate | Dif Data PCIE+ | |
| RN3 | B48 | 3rd mate | Dif Data PCIE- | |
| ---------- | B47 | 2nd mate | | Dif Gnd |
| ---------- | B46 | 3rd mate | Reserved2 <-> | |
| ---------- | B45 | 3rd mate | Reserved3 <-> | |
| ---------- | B44 | 2nd mate | | Dif Gnd |
| RP4 | B43 | 3rd mate | Dif Data PCIE+ | |
| RN4 | B42 | 3rd mate | Dif Data PCIE- | |
| ---------- | B41 | 2nd mate | | Dif Gnd |
| RP5 | B40 | 3rd mate | Dif Data PCIE+ | |
| RN5 | B39 | 3rd mate | Dif Data PCIE- | |
| ---------- | B38 | 2nd mate | | Dif Gnd |
| RP6 | B37 | 3rd mate | Dif Data PCIE+ | |
| RN6 | B36 | 3rd mate | Dif Data PCIE- | |
| ---------- | B35 | 2nd mate | | Dif Gnd |
| RP7 | B34 | 3rd mate | Dif Data PCIE+ | |
| RN7 | B33 | 3rd mate | Dif Data PCIE- | |

FIG. 9

602

| Top row | | | |
|---|---|---|---|
| Pin # | "Plug side shape" | "Receptacle (SMT)" | |
| 1st mate | | | |
| T62 | 3rd mate | CPRSNT1# | |
| T61 | 2nd mate | Opt 3.3V Return <-> | |
| T60 | 3rd mate | Dif Data PCIE+ | TP0 |
| T59 | 3rd mate | Dif Data PCIE- | TN0 |
| T58 | 2nd mate | Dif Gnd | |
| T57 | 3rd mate | Dif Data PCIE+ | TP1 |
| T56 | 3rd mate | Dif Data PCIE- | TN1 |
| T55 | 2nd mate | Dif Gnd | |
| T54 | 3rd mate | Dif Data PCIE+ | TP2 |
| T53 | 3rd mate | Dif Data PCIE- | TN2 |
| T52 | 2nd mate | Dif Gnd | |
| T51 | 3rd mate | Dif Data PCIE+ | TP3 |
| T50 | 3rd mate | Dif Data PCIE- | TP4 |
| T49 | 2nd mate | Dif Gnd | |
| T48 | 3rd mate | Opt 3.3V Power <-> | |
| T47 | 3rd mate | Opt 3.3V Power <-> | |
| T46 | 3rd mate | Opt 3.3V Power <-> | |
| T45 | 3rd mate | Opt 3.3V Power <-> | |
| T44 | 2nd mate | Dif Gnd | |
| T43 | 3rd mate | Dif Data PCIE+ | TP4 |
| T42 | 3rd mate | Dif Data PCIE- | TN4 |
| T41 | 2nd mate | Dif Gnd | |
| T40 | 3rd mate | Dif Data PCIE+ | TP5 |
| T39 | 3rd mate | Dif Data PCIE- | TN5 |
| T38 | 2nd mate | Dif Gnd | |
| T37 | 3rd mate | Dif Data PCIE+ | TP6 |
| T36 | 3rd mate | Dif Data PCIE- | TN6 |
| T35 | 2nd mate | Dif Gnd | |
| T34 | 3rd mate | Dif Data PCIE+ | TP7 |
| T33 | 3rd mate | Dif Data PCIE- | TN7 |

FIG. 10

| | | | |
|---|---|---|---|
| | T31 | Opt 3.3V Return | 2nd mate |
| | T32 | Opt 3.3V Return | 2nd mate |
| TP8 | T33 | Dif Data PCIE+ | 3rd mate |
| TN8 | T34 | Dif Data PCIE- | 3rd mate |
| | T35 | Dif Gnd | 2nd mate |
| TP9 | T36 | Dif Data PCIE+ | 3rd mate |
| TN9 | T37 | Dif Data PCIE- | 3rd mate |
| | T38 | Dif Gnd | 2nd mate |
| TP10 | T39 | Dif Data PCIE+ | 3rd mate |
| TN10 | T40 | Dif Data PCIE- | 3rd mate |
| | T41 | Dif Gnd | 2nd mate |
| TP11 | T42 | Dif Data PCIE+ | 3rd mate |
| TN11 | T43 | Dif Data PCIE- | 3rd mate |
| | T44 | Dif Gnd | 2nd mate |
| | T45 | Reserved | 3rd mate |
| | T46 | CPERST | 3rd mate |
| | T47 | CPWRON | 3rd mate |
| | T48 | CWAKE | 3rd mate |
| | T49 | Dif Gnd | 2nd mate |
| TP12 | T50 | Dif Data PCIE+ | 3rd mate |
| TN12 | T51 | Dif Data PCIE- | 3rd mate |
| | T52 | Dif Gnd | 2nd mate |
| TP13 | T53 | Dif Data PCIE+ | 3rd mate |
| TN13 | T54 | Dif Data PCIE- | 3rd mate |
| | T55 | Dif Gnd | 2nd mate |
| TP14 | T56 | Dif Data PCIE+ | 3rd mate |
| TN14 | T57 | Dif Data PCIE- | 3rd mate |
| | T58 | Dif Gnd | 2nd mate |
| TP15 | T59 | Dif Data PCIE+ | 3rd mate |
| TN15 | T60 | Dif Data PCIE- | 3rd mate |
| | T61 | Opt 3.3V Return <-> | 2nd mate |
| | T62 | CPRSNT2# | 3rd mate |
| | Connector shell | | |

Transmitters

FIG. 11

| | | | |
|---|---|---|---|
| B31 | Dif Gnd | | 2nd mate |
| B32 | Dif Gnd | | 2nd mate |
| B33 | | Dif Data PCIE+ | 3rd mate |
| B34 | | Dif Data PCIE- | 3rd mate |
| B35 | Dif Gnd | | 2nd mate |
| B36 | | Dif Data PCIE+ | 3rd mate |
| B37 | | Dif Data PCIE- | 3rd mate |
| B38 | Dif Gnd | | 2nd mate |
| B39 | | Dif Data PCIE+ | 3rd mate |
| B40 | | Dif Data PCIE- | 3rd mate |
| B41 | Dif Gnd | | 2nd mate |
| B42 | | Dif Data PCIE+ | 3rd mate |
| B43 | | Dif Data PCIE- | 3rd mate |
| B44 | Dif Gnd | | 2nd mate |
| B45 | | Dif Clock <-> | 3rd mate |
| B46 | | Dif Clock <-> | 3rd mate |
| B47 | Dif Gnd | | 2nd mate |
| B48 | | Dif Data PCIE+ | 3rd mate |
| B49 | | Dif Data PCIE- | 3rd mate |
| B50 | Dif Gnd | | 2nd mate |
| B51 | | Dif Data PCIE+ | 3rd mate |
| B52 | | Dif Data PCIE- | 3rd mate |
| B53 | Dif Gnd | | 2nd mate |
| B54 | | Dif Data PCIE+ | 3rd mate |
| B55 | | Dif Data PCIE- | 3rd mate |
| B56 | Dif Gnd | | 2nd mate |
| B57 | | Dif Data PCIE+ | 3rd mate |
| B58 | | Dif Data PCIE- | 3rd mate |
| B59 | Dif Gnd | | 2nd mate |
| B60 | | Opt 3.3V Return | 2nd mate |
| B61 | | Opt 3.3V Power | 3rd mate |
| B62 | SB_RTN | | 2nd mate |
| 1st mate | | | |

Receivers

FIG. 12

| | | | | |
|---|---|---|---|---|
| ---------- | B32 | 2nd mate | | Dif Gnd |
| ---------- | B31 | 2nd mate | | Dif Gnd |
| RP8 | B30 | 3rd mate | Dif Data PCIE+ | |
| RN8 | B29 | 3rd mate | Dif Data PCIE- | |
| ---------- | B28 | 2nd mate | | Dif Gnd |
| RP9 | B27 | 3rd mate | Dif Data PCIE+ | |
| RN9 | B26 | 3rd mate | Dif Data PCIE- | |
| ---------- | B25 | 2nd mate | | Dif Gnd |
| RP10 | B24 | 3rd mate | Dif Data PCIE+ | |
| RN10 | B23 | 3rd mate | Dif Data PCIE- | |
| ---------- | B22 | 2nd mate | | Dif Gnd |
| RP11 | B21 | 3rd mate | Dif Data PCIE+ | |
| RN11 | B20 | 3rd mate | Dif Data PCIE- | |
| ---------- | B19 | 2nd mate | | Dif Gnd |
| DifClkP | B18 | 3rd mate | Dif Clock <-> | |
| DifClkN | B17 | 3rd mate | Dif Clock <-> | |
| ---------- | B16 | 2nd mate | | Dif Gnd |
| RP12 | B15 | 3rd mate | Dif Data PCIE+ | |
| RN12 | B14 | 3rd mate | Dif Data PCIE- | |
| ---------- | B13 | 2nd mate | | Dif Gnd |
| RP13 | B12 | 3rd mate | Dif Data PCIE+ | |
| RN13 | B11 | 3rd mate | Dif Data PCIE- | |
| ---------- | B10 | 2nd mate | | Dif Gnd |
| RP14 | B9 | 3rd mate | Dif Data PCIE+ | |
| RN14 | B8 | 3rd mate | Dif Data PCIE- | |
| ---------- | B7 | 2nd mate | | Dif Gnd |
| RP15 | B6 | 3rd mate | Dif Data PCIE+ | |
| RN15 | B5 | 3rd mate | Dif Data PCIE- | |
| ---------- | B4 | 2nd mate | | Dif Gnd |
| | B3 | 2nd mate | Opt 3.3V Return | |
| | B2 | 3rd mate | Opt 3.3V Power | |
| ---------- | B1 | 2nd mate | | SB_RTN |
| | Connector shell | | | |

Receivers (Trans on GPU)

FIG. 13

| | | | |
|---|---|---|---|
| T32 | 2nd mate | Opt 3.3V Return | |
| T31 | 2nd mate | Opt 3.3V Return | |
| T30 | 3rd mate | Dif Data PCIE+ | TP8 |
| T29 | 3rd mate | Dif Data PCIE- | TN8 |
| T28 | 2nd mate | Dif Gnd | |
| T27 | 3rd mate | Dif Data PCIE+ | TP9 |
| T26 | 3rd mate | Dif Data PCIE- | TN9 |
| T25 | 2nd mate | Dif Gnd | |
| T24 | 3rd mate | Dif Data PCIE+ | TP10 |
| T23 | 3rd mate | Dif Data PCIE- | TN10 |
| T22 | 2nd mate | Dif Gnd | |
| T21 | 3rd mate | Dif Data PCIE+ | TP11 |
| T20 | 3rd mate | Dif Data PCIE- | TN11 |
| T19 | 2nd mate | Dif Gnd | |
| T18 | 3rd mate | Reserved1 <-> | |
| T17 | 3rd mate | CPERST# <-> | |
| T16 | 3rd mate | CPWRON <-> | |
| T15 | 3rd mate | CWAKE# <-> | |
| T14 | 2nd mate | Dif Gnd | |
| T13 | 3rd mate | Dif Data PCIE+ | TP12 |
| T12 | 3rd mate | Dif Data PCIE- | TN12 |
| T11 | 2nd mate | Dif Gnd | |
| T10 | 3rd mate | Dif Data PCIE+ | TP13 |
| T9 | 3rd mate | Dif Data PCIE- | TN13 |
| T8 | 2nd mate | Dif Gnd | |
| T7 | 3rd mate | Dif Data PCIE+ | TP14 |
| T6 | 3rd mate | Dif Data PCIE- | TN14 |
| T5 | 2nd mate | Dif Gnd | |
| T4 | 3rd mate | Dif Data PCIE+ | TP15 |
| T3 | 3rd mate | Dif Data PCIE- | TN15 |
| T2 | 2nd mate | Opt 3.3V Return <-> | |
| T1 | 3rd mate | CPRSNT2# | |
| 1st mate | | | |

Transmitters (Rec on GPU)

FIG. 14

FIG. 15 FIG. 16 FIG. 17 FIG. 18

Host Side 702

| | Top row | | |
|---|---|---|---|
| | Pin # | "Receptacle (SMT)" | "Plug side shape" |
| | Connector shell | | |
| | T1 | CPRSNT1# | 3rd mate |
| | T2 | Opt 3.3V Return <-> | 3rd mate |
| | T3 | Gnd | 2nd mate |
| TP0 | T4 | Dif Data PCIE+ | 3rd mate |
| TN0 | T5 | Dif Data PCIE- | 3rd mate |
| | T6 | Dif Gnd | 2nd mate |
| TP1 | T7 | Dif Data PCIE+ | 3rd mate |
| TN1 | T8 | Dif Data PCIE- | 3rd mate |
| | T9 | Dif Gnd | 2nd mate |
| TP2 | T10 | Dif Data PCIE+ | 3rd mate |
| TN2 | T11 | Dif Data PCIE- | 3rd mate |
| | T12 | Dif Gnd | 2nd mate |
| TP3 | T13 | Dif Data PCIE+ | 3rd mate |
| TN3 | T14 | Dif Data PCIE- | 3rd mate |
| | T15 | Dif Gnd | 2nd mate |
| | T16 | Reserved1 <-> | 3rd mate |
| | T17 | CPERST# <-> | 3rd mate |
| | T18 | CPWRON <-> | 3rd mate |
| | T19 | CWAKE# <-> | 3rd mate |
| | T20 | Dif Gnd | 2nd mate |
| TP4 | T21 | Dif Data PCIE+ | 3rd mate |
| TN4 | T22 | Dif Data PCIE- | 3rd mate |
| | T23 | Dif Gnd | 2nd mate |
| TP5 | T24 | Dif Data PCIE+ | 3rd mate |
| TN5 | T25 | Dif Data PCIE- | 3rd mate |
| | T26 | Dif Gnd | 2nd mate |
| TP6 | T27 | Dif Data PCIE+ | 3rd mate |
| TN6 | T28 | Dif Data PCIE- | 3rd mate |
| | T29 | Dif Gnd | 2nd mate |
| TP7 | T30 | Dif Data PCIE+ | 3rd mate |
| TN7 | T31 | Dif Data PCIE- | 3rd mate |
| | T32 | Gnd | 2nd mate |
| | T33 | Opt 3.3V Power <-> | 3rd mate |
| | T34 | CPRSNT2# | 3rd mate |
| | Connector shell | | |

Transmitters

FIG. 15

| Bottom row | | | |
|---|---|---|---|
| Pin # | "Receptacle (Through hole)" | | "Plug side shape" |
| 1st mate | | | |
| B1 | SB_RTN | | 2nd mate |
| B2 | | Opt 3.3V Power | 3rd mate |
| B3 | | Opt 3.3V Return | 2nd mate |
| B4 | Dif Gnd | | 2nd mate |
| B5 | | Dif Data PCIE+ | 3rd mate |
| B6 | | Dif Data PCIE- | 3rd mate |
| B7 | Dif Gnd | | 2nd mate |
| B8 | | Dif Data PCIE+ | 3rd mate |
| B9 | | Dif Data PCIE- | 3rd mate |
| B10 | Dif Gnd | | 2nd mate |
| B11 | | Dif Data PCIE+ | 3rd mate |
| B12 | | Dif Data PCIE- | 3rd mate |
| B13 | Dif Gnd | | 2nd mate |
| B14 | | Dif Data PCIE+ | 3rd mate |
| B15 | | Dif Data PCIE- | 3rd mate |
| B16 | Dif Gnd | | 2nd mate |
| B17 | | Dif Clock | 3rd mate |
| B18 | | Dif Clock | 3rd mate |
| B19 | Dif Gnd | | 2nd mate |
| B20 | | Dif Data PCIE+ | 3rd mate |
| B21 | | Dif Data PCIE- | 3rd mate |
| B22 | Dif Gnd | | 2nd mate |
| B23 | | Dif Data PCIE+ | 3rd mate |
| B24 | | Dif Data PCIE- | 3rd mate |
| B25 | Dif Gnd | | 2nd mate |
| B26 | | Dif Data PCIE+ | 3rd mate |
| B27 | | Dif Data PCIE- | 3rd mate |
| B28 | Dif Gnd | | 2nd mate |
| B29 | | Dif Data PCIE+ | 3rd mate |
| B30 | | Dif Data PCIE- | 3rd mate |
| B31 | Dif Gnd | | 2nd mate |
| B32 | | Opt 3.3V Return | 2nd mate |
| B33 | | Opt 3.3V Power | 3rd mate |
| B34 | SB_RTN | | 2nd mate |
| 1st mate | | | |

Receivers

FIG. 16

Downstream side 704

| 706 Cable | Bottom row | | | | |
|---|---|---|---|---|---|
| | Pin # | "Plug side shape" | "Receptacle (Through hole)" | | |
| | Connector shell | | | | |
| ---------- | B34 | 2nd mate | | SB_RTN | |
| | B33 | 3rd mate | Opt 3.3V Power | | |
| | B32 | 2nd mate | Opt 3.3V Return | | |
| ---------- | B31 | 2nd mate | | Dif Gnd | |
| RP0 | B30 | 3rd mate | Dif Data PCIE+ | | |
| RN0 | B29 | 3rd mate | Dif Data PCIE- | | |
| ---------- | B28 | 2nd mate | | Dif Gnd | |
| RP1 | B27 | 3rd mate | Dif Data PCIE+ | | |
| RN1 | B26 | 3rd mate | Dif Data PCIE- | | |
| ---------- | B25 | 2nd mate | | Dif Gnd | |
| RP2 | B24 | 3rd mate | Dif Data PCIE+ | | |
| RN2 | B23 | 3rd mate | Dif Data PCIE- | | |
| ---------- | B22 | 2nd mate | | Dif Gnd | |
| RP3 | B21 | 3rd mate | Dif Data PCIE+ | | |
| RN3 | B20 | 3rd mate | Dif Data PCIE- | | |
| ---------- | B19 | 2nd mate | | Dif Gnd | |
| DifClkP | B18 | 3rd mate | Dif Clock | | |
| DifClkN | B17 | 3rd mate | Dif Clock | | |
| ---------- | B16 | 2nd mate | | Dif Gnd | |
| RP4 | B15 | 3rd mate | Dif Data PCIE+ | | |
| RN4 | B14 | 3rd mate | Dif Data PCIE- | | |
| ---------- | B13 | 2nd mate | | Dif Gnd | |
| RP5 | B12 | 3rd mate | Dif Data PCIE+ | | |
| RN5 | B11 | 3rd mate | Dif Data PCIE- | | |
| ---------- | B10 | 2nd mate | | Dif Gnd | |
| RP6 | B9 | 3rd mate | Dif Data PCIE+ | | |
| RN6 | B8 | 3rd mate | Dif Data PCIE- | | |
| ---------- | B7 | 2nd mate | | Dif Gnd | |
| RP7 | B6 | 3rd mate | Dif Data PCIE+ | | |
| RN7 | B5 | 3rd mate | Dif Data PCIE- | | |
| ---------- | B4 | 2nd mate | | Dif Gnd | |
| | B3 | 2nd mate | Opt 3.3V Return | | |
| | B2 | 3rd mate | Opt 3.3V Power | | |
| ---------- | B1 | 2nd mate | | SB_RTN | |
| | Connector shell | | | | |
| | Receivers (Trans on GPU) | | | | |

FIG. 17

| Top row | | | |
|---|---|---|---|
| Pin # | "Plug side shape" | "Receptacle (SMT)" | |
| 1st mate | | | |
| T34 | 3rd mate | CPRSNT1# | |
| T33 | 3rd mate | Opt 3.3V Return <-> | |
| T32 | 2nd mate | Gnd | |
| T31 | 3rd mate | Dif Data PCIE+ | TP0 |
| T30 | 3rd mate | Dif Data PCIE- | TN0 |
| T29 | 2nd mate | Dif Gnd | |
| T28 | 3rd mate | Dif Data PCIE+ | TP1 |
| T27 | 3rd mate | Dif Data PCIE- | TN1 |
| T26 | 2nd mate | Dif Gnd | |
| T25 | 3rd mate | Dif Data PCIE+ | TP2 |
| T24 | 3rd mate | Dif Data PCIE- | TN2 |
| T23 | 2nd mate | Dif Gnd | |
| T22 | 3rd mate | Dif Data PCIE+ | TP3 |
| T21 | 3rd mate | Dif Data PCIE- | TP4 |
| T20 | 2nd mate | Dif Gnd | |
| T19 | 3rd mate | Reserved1 <-> | |
| T18 | 3rd mate | CPERST# <-> | |
| T17 | 3rd mate | CPWRON <-> | |
| T16 | 3rd mate | CWAKE# <-> | |
| T15 | 2nd mate | Dif Gnd | |
| T14 | 3rd mate | Dif Data PCIE+ | TP4 |
| T13 | 3rd mate | Dif Data PCIE- | TN4 |
| T12 | 2nd mate | Dif Gnd | |
| T11 | 3rd mate | Dif Data PCIE+ | TP5 |
| T10 | 3rd mate | Dif Data PCIE- | TN5 |
| T9 | 2nd mate | Dif Gnd | |
| T8 | 3rd mate | Dif Data PCIE+ | TP6 |
| T7 | 3rd mate | Dif Data PCIE- | TN6 |
| T6 | 2nd mate | Dif Gnd | |
| T5 | 3rd mate | Dif Data PCIE+ | TP7 |
| T4 | 3rd mate | Dif Data PCIE- | TN7 |
| T3 | 2nd mate | Gnd | |
| T2 | 3rd mate | Opt 3.3V Power <-> | |
| T1 | 3rd mate | CPRSNT2# | |
| 1st mate | | | |

Transmitters (Rec on GPU)

FIG. 18

| | | | |
|---|---|---|---|
| | | FIG. 21 | FIG. 22 |
| FIG. 19 | FIG. 20 | FIG. 23 | FIG. 24 |

| | | | |
|---|---|---|---|
| | Connector shell | | |
| \|__ | T1 | CPRSNT1# | 3rd mate |
| | T2 | Opt 3.3V Return <-> | 3rd mate |
| -------- | T3 | Gnd | 2nd mate |
| TP0 | T4 | Dif Data PCIE+ | 3rd mate |
| TN0 | T5 | Dif Data PCIE- | 3rd mate |
| -------- | T6 | Dif Gnd | 2nd mate |
| TP1 | T7 | Dif Data PCIE+ | 3rd mate |
| TN1 | T8 | Dif Data PCIE- | 3rd mate |
| -------- | T9 | Dif Gnd | 2nd mate |
| TP2 | T10 | Dif Data PCIE+ | 3rd mate |
| TN2 | T11 | Dif Data PCIE- | 3rd mate |
| -------- | T12 | Dif Gnd | 2nd mate |
| TP3 | T13 | Dif Data PCIE+ | 3rd mate |
| TN3 | T14 | Dif Data PCIE- | 3rd mate |
| -------- | T15 | Dif Gnd | 2nd mate |
| -------- | T16 | Reserved1 <-> | 3rd mate |
| -------- | T17 | CPERST# <-> | 3rd mate |
| -------- | T18 | CPWRON <-> | 3rd mate |
| -------- | T19 | CWAKE# <-> | 3rd mate |
| -------- | T20 | Dif Gnd | 2nd mate |
| TP4 | T21 | Dif Data PCIE+ | 3rd mate |
| TN4 | T22 | Dif Data PCIE- | 3rd mate |
| -------- | T23 | Dif Gnd | 2nd mate |
| TP5 | T24 | Dif Data PCIE+ | 3rd mate |
| TN5 | T25 | Dif Data PCIE- | 3rd mate |
| -------- | T26 | Dif Gnd | 2nd mate |
| TP6 | T27 | Dif Data PCIE+ | 3rd mate |
| TN6 | T28 | Dif Data PCIE- | 3rd mate |
| -------- | T29 | Dif Gnd | 2nd mate |
| TP7 | T30 | Dif Data PCIE+ | 3rd mate |
| TN7 | T31 | Dif Data PCIE- | 3rd mate |
| -------- | T32 | Gnd | 2nd mate |
| | T33 | Opt 3.3V Power <-> | 3rd mate |
| -------- | T34 | CPRSNT2# | 3rd mate |
| | | Connector shell | |

Transmitters

FIG. 19

702

| 1st mate | | | | Flat Cable |
|---|---|---|---|---|
| B1 | SB_RTN | | 2nd mate | |
| B2 | | Opt 3.3V Power | 3rd mate | |
| B3 | | Opt 3.3V Return | 2nd mate | |
| B4 | Dif Gnd | | 2nd mate | ---------- |
| B5 | | Dif Data PCIE+ | 3rd mate | RP0 |
| B6 | | Dif Data PCIE- | 3rd mate | RN0 |
| B7 | Dif Gnd | | 2nd mate | ---------- |
| B8 | | Dif Data PCIE+ | 3rd mate | RP1 |
| B9 | | Dif Data PCIE- | 3rd mate | RN1 |
| B10 | Dif Gnd | | 2nd mate | ---------- |
| B11 | | Dif Data PCIE+ | 3rd mate | RP2 |
| B12 | | Dif Data PCIE- | 3rd mate | RN2 |
| B13 | Dif Gnd | | 2nd mate | ---------- |
| B14 | | Dif Data PCIE+ | 3rd mate | RP3 |
| B15 | | Dif Data PCIE- | 3rd mate | RN3 |
| B16 | Dif Gnd | | 2nd mate | ---------- |
| B17 | | Dif Clock | 3rd mate | DifClkP |
| B18 | | Dif Clock | 3rd mate | DifClkN |
| B19 | Dif Gnd | | 2nd mate | ---------- |
| B20 | | Dif Data PCIE+ | 3rd mate | RP4 |
| B21 | | Dif Data PCIE- | 3rd mate | RN4 |
| B22 | Dif Gnd | | 2nd mate | ---------- |
| B23 | | Dif Data PCIE+ | 3rd mate | RP5 |
| B24 | | Dif Data PCIE- | 3rd mate | RN5 |
| B25 | Dif Gnd | | 2nd mate | ---------- |
| B26 | | Dif Data PCIE+ | 3rd mate | RP6 |
| B27 | | Dif Data PCIE- | 3rd mate | RN6 |
| B28 | Dif Gnd | | 2nd mate | ---------- |
| B29 | | Dif Data PCIE+ | 3rd mate | RP7 |
| B30 | | Dif Data PCIE- | 3rd mate | RN7 |
| B31 | Dif Gnd | | 2nd mate | ---------- |
| B32 | | Opt 3.3V Return | 2nd mate | |
| B33 | | Opt 3.3V Power | 3rd mate | |
| B34 | SB_RTN | | 2nd mate | ---------- |
| | | 1st mate | | |

Receivers

FIG. 20

Downstream side 600

| Bottom Row | | | | | |
|---|---|---|---|---|---|
| Pin # | "From Pin #" | "Plug side shape" | "Receptacle (Through hole)" | | |
| | | | Connector shell | | |
| B62 | B1 | 2nd mate | | SB_RTN | 1 |
| B61 | L | 3rd mate | Opt 3.3V Power | | 2 |
| B60 | L | 2nd mate | Opt 3.3V Return | | 3 |
| B59 | L | 2nd mate | | Dif Gnd | 4 |
| B58 | L | 3rd mate | Dif Data PCIE+ | | 5 |
| B57 | L | 3rd mate | Dif Data PCIE- | | 6 |
| B56 | L | 2nd mate | | Dif Gnd | 7 |
| B55 | L | 3rd mate | Dif Data PCIE+ | | 8 |
| B54 | L | 3rd mate | Dif Data PCIE- | | 9 |
| B53 | L | 2nd mate | | Dif Gnd | 10 |
| B52 | L | 3rd mate | Dif Data PCIE+ | | 11 |
| B51 | L | 3rd mate | Dif Data PCIE- | | 12 |
| B50 | L | 2nd mate | | Dif Gnd | 13 |
| B49 | L | 3rd mate | Dif Data PCIE+ | | 14 |
| B48 | L | 3rd mate | Dif Data PCIE- | | 15 |
| B47 | L | 2nd mate | | Dif Gnd | 16 |
| B46 | L | 3rd mate | Reserved2 <-> | | 17 |
| B45 | L | 3rd mate | Reserved3 <-> | | 18 |
| B44 | L | 2nd mate | | Dif Gnd | 19 |
| B43 | L | 3rd mate | Dif Data PCIE+ | | 20 |
| B42 | L | 3rd mate | Dif Data PCIE- | | 21 |
| B41 | L | 2nd mate | | Dif Gnd | 22 |
| B40 | L | 3rd mate | Dif Data PCIE+ | | 23 |
| B39 | L | 3rd mate | Dif Data PCIE- | | 24 |

FIG. 21

602

| Top Row | | | | |
|---|---|---|---|---|
| Pin # | "From Pin #" | "Plug side shape" | "Receptacle (SMT)" | |
| | | 1st Mate | | |
| T62 | T1 | 3rd mate | CPRSNT1# | |
| T61 | L | 2nd mate | Opt 3.3V Return <-> | |
| T60 | L | 3rd mate | Dif Data PCIE+ | TP0 |
| T59 | L | 3rd mate | Dif Data PCIE- | TN0 |
| T58 | L | 2nd mate | Dif Gnd | |
| T57 | L | 3rd mate | Dif Data PCIE+ | TP1 |
| T56 | L | 3rd mate | Dif Data PCIE- | TN1 |
| T55 | L | 2nd mate | Dif Gnd | |
| T54 | L | 3rd mate | Dif Data PCIE+ | TP2 |
| T53 | L | 3rd mate | Dif Data PCIE- | TN2 |
| T52 | L | 2nd mate | Dif Gnd | |
| T51 | L | 3rd mate | Dif Data PCIE+ | TP3 |
| T50 | L | 3rd mate | Dif Data PCIE- | TP4 |
| T49 | L | 2nd mate | Dif Gnd | |
| T48 | L | 3rd mate | Opt 3.3V Power <-> | |
| T47 | L | 3rd mate | Opt 3.3V Power <-> | |
| T46 | L | 3rd mate | Opt 3.3V Power <-> | |
| T45 | L | 3rd mate | Opt 3.3V Power <-> | |
| T44 | L | 2nd mate | Dif Gnd | |
| T43 | L | 3rd mate | Dif Data PCIE+ | TP4 |
| T42 | L | 3rd mate | Dif Data PCIE- | TN4 |
| T41 | L | 2nd mate | Dif Gnd | |
| T40 | L | 3rd mate | Dif Data PCIE+ | TP5 |
| T39 | L | 3rd mate | Dif Data PCIE- | TN5 |

FIG. 22

| | | | | | |
|---|---|---|---|---|---|
| B38 | L | 2nd mate | | Dif Gnd | 25 |
| B37 | L | 3rd mate | Dif Data PCIE+ | | 26 |
| B36 | L | 3rd mate | Dif Data PCIE- | | 27 |
| B35 | L | 2nd mate | | Dif Gnd | 28 |
| B34 | L | 3rd mate | Dif Data PCIE+ | | 29 |
| B33 | L | 3rd mate | Dif Data PCIE- | | 30 |
| B32 | L | 2nd mate | | Dif Gnd | 31 |
| B31 | B4 | 2nd mate | | Dif Gnd | 32 |
| B30 | B5 | 3rd mate | Dif Data PCIE+ | | 33 |
| B29 | B6 | 3rd mate | Dif Data PCIE- | | 34 |
| B28 | B7 | 2nd mate | | Dif Gnd | 35 |
| B27 | B8 | 3rd mate | Dif Data PCIE+ | | 36 |
| B26 | B9 | 3rd mate | Dif Data PCIE- | | |
| B25 | B10 | 2nd mate | | Dif Gnd | |
| B24 | B11 | 3rd mate | Dif Data PCIE+ | | |
| B23 | B12 | 3rd mate | Dif Data PCIE- | | |
| B22 | B13 | 2nd mate | | Dif Gnd | |
| B21 | B14 | 3rd mate | Dif Data PCIE+ | | |
| B20 | B15 | 3rd mate | Dif Data PCIE- | | |
| B19 | B16 | 2nd mate | | Dif Gnd | |
| B18 | B17 | 3rd mate | Dif Clock <-> | | |
| B17 | B18 | 3rd mate | Dif Clock <-> | | |
| B16 | B19 | 2nd mate | | Dif Gnd | |
| B15 | B20 | 3rd mate | Dif Data PCIE+ | | |
| B14 | B21 | 3rd mate | Dif Data PCIE- | | |
| B13 | B22 | 2nd mate | | Dif Gnd | |
| B12 | B23 | 3rd mate | Dif Data PCIE+ | | |
| B11 | B24 | 3rd mate | Dif Data PCIE- | | |
| B10 | B25 | 2nd mate | | Dif Gnd | |
| B9 | B26 | 3rd mate | Dif Data PCIE+ | | |
| B8 | B27 | 3rd mate | Dif Data PCIE- | | |
| B7 | B28 | 2nd mate | | Dif Gnd | |
| B6 | B29 | 3rd mate | Dif Data PCIE+ | | |
| B5 | B30 | 3rd mate | Dif Data PCIE- | | |
| B4 | B31 | 2nd mate | | Dif Gnd | |
| B3 | L | 2nd mate | Opt 3.3V Return | | |
| B2 | L | 3rd mate | Opt 3.3V Power | | |
| B1 | B34 | 2nd mate | | SB_RTN | |
| | | | Connector shell | | |

Receivers (Trans on GPU)

FIG. 23

| | | | | | |
|---|---|---|---|---|---|
| | T38 | L | 2nd mate | Dif Gnd | |
| | T37 | L | 3rd mate | Dif Data PCIE+ | TP6 |
| | T36 | L | 3rd mate | Dif Data PCIE- | TN6 |
| | T35 | L | 2nd mate | Dif Gnd | |
| | T34 | L | 3rd mate | Dif Data PCIE+ | TP7 |
| | T33 | L | 3rd mate | Dif Data PCIE- | TN7 |
| | T32 | L | 2nd mate | Opt 3.3V Return | |
| | T31 | L | 2nd mate | Opt 3.3V Return | |
| | T30 | T4 | 3rd mate | Dif Data PCIE+ | TP8 |
| | T29 | T5 | 3rd mate | Dif Data PCIE- | TN8 |
| | T28 | T6 | 2nd mate | Dif Gnd | |
| | T27 | T7 | 3rd mate | Dif Data PCIE+ | TP9 |
| | T26 | T8 | 3rd mate | Dif Data PCIE- | TN9 |
| | T25 | T9 | 2nd mate | Dif Gnd | |
| | T24 | T10 | 3rd mate | Dif Data PCIE+ | TP10 |
| | T23 | T11 | 3rd mate | Dif Data PCIE- | TN10 |
| | T22 | T12 | 2nd mate | Dif Gnd | |
| | T21 | T13 | 3rd mate | Dif Data PCIE+ | TP11 |
| | T20 | T14 | 3rd mate | Dif Data PCIE- | TN11 |
| | T19 | T15 | 2nd mate | Dif Gnd | |
| | T18 | T16 | 3rd mate | Reserved1 <-> | CONTROL SIGNALS |
| | T17 | T17 | 3rd mate | CPERST# <-> | CONTROL SIGNALS |
| | T16 | T18 | 3rd mate | CPWRON <-> | CONTROL SIGNALS |
| | T15 | T19 | 3rd mate | CWAKE# <-> | CONTROL SIGNALS |
| | T14 | T20 | 2nd mate | Dif Gnd | |
| | T13 | T21 | 3rd mate | Dif Data PCIE+ | TP12 |
| | T12 | T22 | 3rd mate | Dif Data PCIE- | TN12 |
| | T11 | T23 | 2nd mate | Dif Gnd | |
| | T10 | T24 | 3rd mate | Dif Data PCIE+ | TP13 |
| | T9 | T25 | 3rd mate | Dif Data PCIE- | TN13 |
| | T8 | T26 | 2nd mate | Dif Gnd | |
| | T7 | T27 | 3rd mate | Dif Data PCIE+ | TP14 |
| | T6 | T28 | 3rd mate | Dif Data PCIE- | TN14 |
| | T5 | T29 | 2nd mate | Dif Gnd | |
| | T4 | T30 | 3rd mate | Dif Data PCIE+ | TP15 |
| | T3 | T31 | 3rd mate | Dif Data PCIE- | TN15 |
| | T2 | L | 2nd mate | Opt 3.3V Return <-> | |
| | T1 | T34 | 3rd mate | CPRSNT2# | |
| | | | 1st Mate | | |

Transmitters (Rec on GPU)

FIG. 24

ELECTRICAL CONNECTOR, CABLE AND APPARATUS UTILIZING SAME

RELATED CO-PENDING APPLICATIONS

This application is related to co-pending applications entitled "ELECTRONIC DEVICES USING DIVIDED MULTI-CONNECTOR ELEMENT DIFFERENTIAL BUS CONNECTOR", filed on even date, having Ser. No. 11/955,798, inventors James Hunkins et al., owned by instant Assignee and is incorporated herein by reference; and "DISPLAY SYSTEM WITH FRAME REUSE USING DIVIDED MULTI-CONNECTOR ELEMENT DIFFERENTIAL BUS CONNECTOR", filed on even date, having Ser. No. 11/955,783, inventors James Hunkins et al, owned by instant Assignee and is incorporated herein by reference.

FIELD OF THE INVENTION

The disclosure relates generally to electrical connectors and cable systems, and more particularly to electrical connectors and cable systems that facilitate high speed data communication.

BACKGROUND OF THE INVENTION

Electronic devices such as laptops, desktops, mobile phones and other devices may employ one or more graphics processing circuits such as a graphics processor (e.g. a graphics core co-located on a die with a host CPU, separate chip coupled to a mother board, or located on a plug-in card, a graphics core integrated with a memory bridge circuit, or any other suitable configuration) to provide graphics data and/or video information, video display data to one or more displays.

One type of communication interface design to provide the necessary high data rates and communication performance for graphics and/or video information between a graphics processor and CPU or any other devices is known as a PCI Express™ interface. This is a communication link that is a serial communications channel made up of sets of two differential wire pairs that provide for example 2.5 Mbytes per second (Gen1) or 5.0 Mbytes/sec (Gen2) in each direction. Up to 32 of these "lanes" may be combined in times 2, times 4, times 8, times 16, times 32 configurations, creating a parallel interface of independently controlled serial links. However, any other suitable communication link may also be employed. Due to the ever increasing requirements of multimedia applications that require the generation of graphics information from drawing commands, or a suitable generation of video puts increasing demands on the graphics processing circuitry and system. This can require larger integrated graphics processing circuits which generate additional heat requiring cooling systems such as active cooling systems such as fans and associated ducting, or passive cooling systems in desktops, laptops or other devices. There are limits to the amount of heat that can be dissipated by a given electronic device.

It has been proposed to provide external graphics processing in a separate device from the laptop, desktop or mobile device to allow faster generation of graphics processing through parallel graphics processing operations or to provide output to multiple displays using external graphics devices. However, since devices are becoming smaller and smaller there is an ever increasing need to design connections, including connectors and cabling that allow proper consumer acceptance and suitable speed and cost advantages. Certain video games for example may require high bandwidth graphics processing which may not be available given the cost, integrated circuit size, heat dissipation, and other factors available on a mobile device or non-mobile device.

From an electrical connector standpoint, for years there have been attempts by various industries to design connectors that provide the requisite bandwidths such as the multiple gigabytes necessary to communicate video frame information and/or graphics information between devices. One proposal has been to provide an external cable and circuit board connector that uses for example a 16 lane configuration for PCI-e™. This proposal results in a printed circuit board footprint of approximately 40.3 mm×26.4 mm and a connector housing depth profile 40.3 mm×11.9 mm which includes the shell depth and housing of the connector. However, such large connectors have only been suitable for larger devices such as servers which can take up large spaces and can be many pounds in weight. For the consumer market such large connectors are too large and costly. A long felt need has existed for a suitable connector to accommodate multiple lanes of communication to provide the necessary bandwidth for graphics and video information.

Other connectors such as DisplayPort™ connectors are limited to only for example two lanes, although they have smaller footprints they cannot support the PCI-e™ cable specification features and have limited capabilities. Other proposals that allow for, for example a 16 lane PCI-e™ connection have even larger footprints and profiles and may employ for example 136 pin total stacked connector to accommodate 16 lanes (VHDCI). The size of the footprint and profile can be for example in excess of 42 millimeters by 19 millimeters for the footprint and in excess of 42 by 12 millimeters in terms of the PCI-e™ board profile that the connector takes up. Again, such connectors require the size of the mobile device or laptop device to be too large or can take up an unreasonable amount of real estate on the PC board or device housing to accommodate the size of such large connectors. In addition, such connectors also utilize large cabling which can be heavy and cumbersome in use with laptop devices. The costs can also be unreasonably high. In addition, motherboard space is at a premium and as such larger connectors are not practical.

From an electronic device perspective, providing external graphics processing capability in a separate device is also known. For example, docking stations are known that employ a PCI-e™ interface connector that includes a single lane to communicate with the CPU in for example a laptop computer that is plugged into the docking station. The docking station includes its own A/C connector and has additional display connector ports to allow external displays to be connected directly to the docking station. The laptop which may have for example its own LCD display and internal graphics processing circuitry in the form of an integrated graphics processing core or card, utilizes the laptop's CPU to send drawing commands via the single lane PCI-e™ express connector to the external graphics processor located in the docking station. However, such configurations can be too slow and typically employ a low end graphics processor since there is only a single lane of communication capability provided.

Other external electronic units that employ graphics processing circuitry to enhance the graphics processing capabilities of a desktop, laptop or other device are also known that employ for example a signal repeater that increases the signal strength of graphics communications across a multilane PCI-e™ connector. However, the connector is a large pin connector with large space in between pins resulting in a connector having approximately 140 pins if 16 lanes are used. The layout requirements on the mother board as well as the size of the connectors are too large. As a result, actual devices typically employ for example a single lane (approximately 18 pin connector) connector including many control pins. As such, although manufacturers may describe wanting to accommodate multilane PCI-e™ communications, practical applications by the manufacturers typically result in a single lane configuration. This failure to be able to suitably design and manufacture a suitably sized connector has been a long standing problem.

Other external devices allow PCI-e™ graphics cards to be used in notebooks. Again these typically use a single lane PCI-e™ connector. Such devices may include a display panel that displays information such as a games current frame rate per second, clock speed and cooling fan speed which may be adjusted by for example a function knob or through software as desired. A grill may be provided for example on a rear or side panel so that the graphics card may be visible inside and may also provide ventilation. The internal graphics card may be over-clocked in real time by turning a control knob for example to attempt to increase performance of the external graphics processing capability. However, as noted, the communication link between the CPU and the laptop and the external electronic device with the graphics card typically has a single PCI-e™ lane limiting the capability of the graphics card.

Accordingly, a need exists for an improved connector and/or cable and/or electronic device that provides external graphics processing and/or interconnection of an external graphics processor with a portable device or non-portable device that employs for example it own CPU or set of CPUs and if desired its own graphics processing capability.

BRIEF DESCRIPTION OF THE DRAWINGS

The invention will be more readily understood in view of the following description when accompanied by the below figures and wherein like reference numerals represent like elements, wherein:

FIGS. 7-14 are diagrams illustrating signaling provided by the electrical connector of FIG. 1 and cable connector of FIG. 6 in an electronic device or system in accordance with one disclosure set forth;

FIGS. 15-18 are diagrams illustrating signaling provided by the electrical connector of FIG. 1 and cable connector of FIG. 6 in an electronic device or system in accordance with one disclosure set forth;

FIGS. 19-24 are diagrams illustrating signaling provided by the electrical connector of FIG. 1 and cable connector of FIG. 6 in an electronic device or system in accordance with one disclosure set forth.

DETAILED DESCRIPTION OF THE PREFERRED EMBODIMENTS

Figure 6:
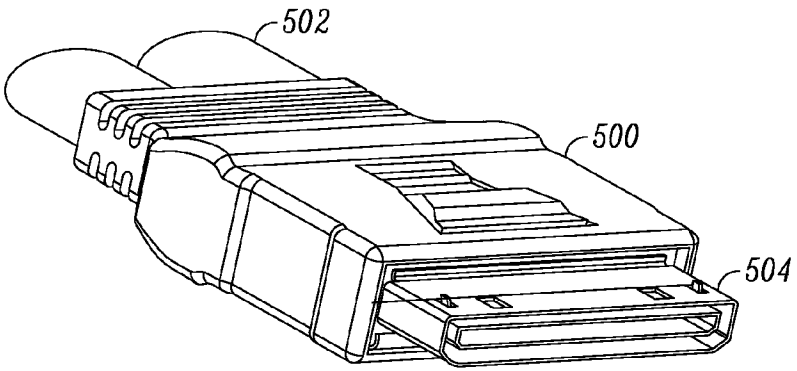
FIG. 6 is a perspective view illustrating one example of a cable connector that mates with the connector of FIG. 1 in accordance with one example set forth in the disclosure.

Briefly, an electrical connector, also referred to as a divided multi-connector element differential bus connector, such as a circuit board connector, includes a housing having therein a divided multi-connector element. The electrical connector is adapted to electrically connect with a substrate, such as a circuit board. The divided multi-connector element includes a divided electrical contact configuration that includes a first group or subassembly of electrical contacts physically separate from an adjacent and second group or subassembly of contacts. The first group of electrical contacts and second group of electrical contacts each include a row of lower contacts and upper contacts. The second group of electrical contacts has an identical but mirrored configuration (e.g., with respect to a vertical axis) as the first group of electrical contacts.

In one example, the electrical connector housing is sized to provide a substrate footprint of approximately 12 mm×53 mm and has a profile of approximately 53 mm×6 mm and includes 124 pins configured for a 16 lane differential bus. The 16 lanes are divided into two 8 lane pin groupings. Also in one example, the first and second group of contacts include an end grounding contact wherein a respective end grounding contact is positioned adjacent to another end grounding contact in the other group and are located substantially in the center of the connector housing. Also in one example, rows of upper contacts are surface mount pins and rows of lower contacts are through hole pins that pass through the substrate.

An electrical device is also disclosed that employs the above mentioned electrical connector and has an electronic circuit substrate coupled to the electrical connector and also includes electronic circuitry located on the electronic circuit substrate that is coupled to the first and second group of electrical contacts. The electronic circuitry provides a plurality of differential data pair signals on either side of a center portion of the connector and also provides differential clock signals in a center portion of the first group of electrical contacts. The first row of upper contacts are used to provide control signals associated with the differential pair signals.

The second group of contacts are coupled such that the second row of lower contacts includes a plurality of differential data signals that are provided on adjacent pins separated by differential ground. A cable is also disclosed that has same end connectors that mate with the electrical connectors. In one example, the cable assembly has a 16 lane connector on one end and an 8 lane connector on the other, adapted to electrically mate with only the first group of electrical contacts in the 16 lane connector and not the second group of electrical contacts thereby allowing a 16 lane board connector to be used to connect to an 8 lane unit.

One of the many advantages of the disclosed connector or cable or electronic device include the providing of a compact connector that provides high speed communication via a multilane differential signaling bus, such as a PCI Express™ compatible bus or interface. Additionally, an 8 lane connector may also be suitably connected with a 16 pin board connector via an 8 lane cabling system since a group of contacts and electronic circuitry provides the necessary data clock signal through a single grouping of contacts.

Figure 1:
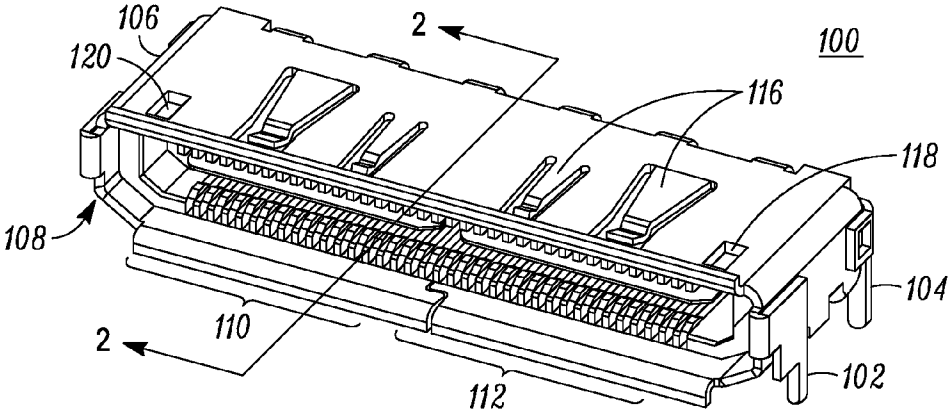
FIG. 1 is a perspective view illustrating one example of an electrical connector in accordance with one example set forth in the disclosure.
Figure 2:
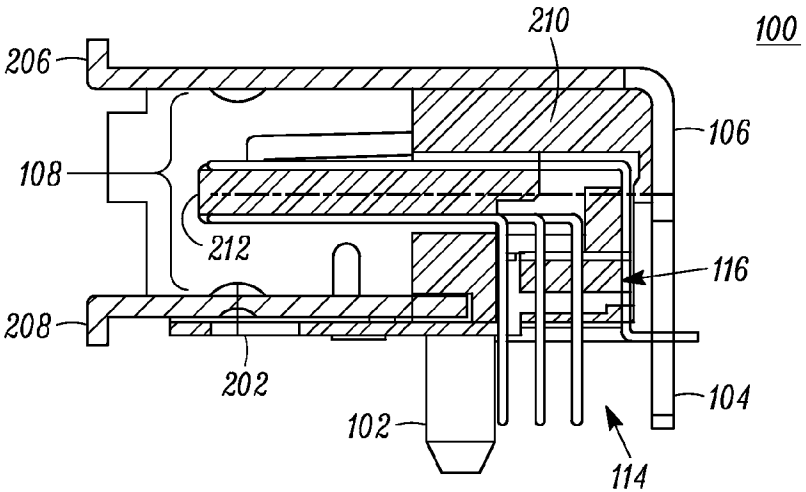
FIG. 2 is a cross sectional view of the connector of FIG. 1.

Referring to FIGS. 1 and 2, one example of an electrical connector 100 that may be coupled to a circuit substrate, such as a printed circuit board, includes a substrate positioning or locating pin 102 and a shell or housing connection post 104. The positioning pin 102 and housing connection post 104 are configured to pass through holes that have been drilled in the circuit substrate and facilitate the mounting of the electrical connector to the substrate. The electrical connector 100 includes a housing 106 that includes a divided multi-connector element 108 that is adapted to electrically connect with a circuit substrate, via for example separate subassemblies of contact pins. The divided multi-connector element 108 includes a divided electrical contact pin configuration that includes a first group or subassembly of electrical contacts 110 that are physically separate or disconnected from an adjacent and second group or subassembly of contacts 112.

Figure 3:
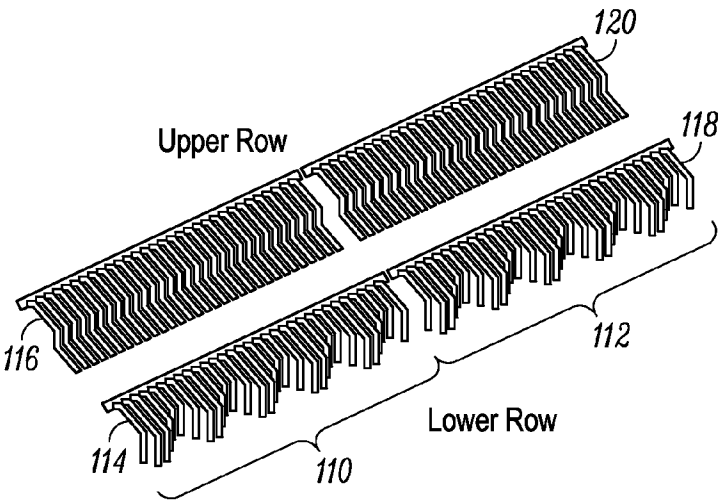
FIG. 3 illustrates one example of upper and lower rows of contacts used in the connector of FIG. 1.

Referring also to FIG. 3, the first group of electrical contacts 110 includes a row of lower contacts 114 and a row of upper contacts 116. Similarly, the second and separate group of electrical contacts 112 includes an identical but mirrored configuration as the first group of electrical contacts and as such, has identical and mirrored but separate corresponding rows of lower contacts 118 and upper row of contacts 120. In this example, the first group of electrical contacts 110 form a complete 8 lane PCI Express™ communication interface when coupled to a PCI Express™ transceiver circuit, such transceiver circuits are known in the art. The rows of lower contacts 114 and 118 separate subassemblies and are through hole pins in this example. They are coupled in an electronic device to include and provide connection with differential receivers or transceivers (see for example, FIGS. 7-14). The groups of top rows of contact pins 116 and 120 are surface mount pins which mount to a surface of the circuit substrate, and are coupled to an electronic circuit to provide differential transmission signals. In this example, a 16 lane PCI Express™ compatible connection can be facilitated in a small profile and relatively inexpensive connector design. Each separate groupings of contacts are electronically connected to each provide 8 lanes of differential signaling based communication resulting in the 16 lane communication bus.

Referring back to FIG. 1, the housing 106 may be made of any suitable material including insulating plastic or any suitable composite material as known in the art. The electrical contacts may also be made of any suitable material such as copper alloys with suitable plating such as gold plating over nickel or any other suitable material and finish as desired. The lower row of contacts 114 in the first group are fabricated as a separate set of lower row of pins and serves as a subassembly of the connector 100. Lower row of contacts 118 are an identical and mirrored subassembly and separate from the lower row of contacts 114. Similarly, the upper row of contacts 116 and 120 are configured as separate assemblies each identical and mirrored to one another. In this example, a total of four sets of pins are used to provide the two groupings of upper and lower contacts. Among other advantages, the separation of the lower and upper contacts into separate subassemblies can help reduce the number of pins required to provide the signaling required for a 16 lane or 8 lane PCI Express™ type bus. Other advantages will be recognized by those of ordinary skill in the art.

Figure 4:
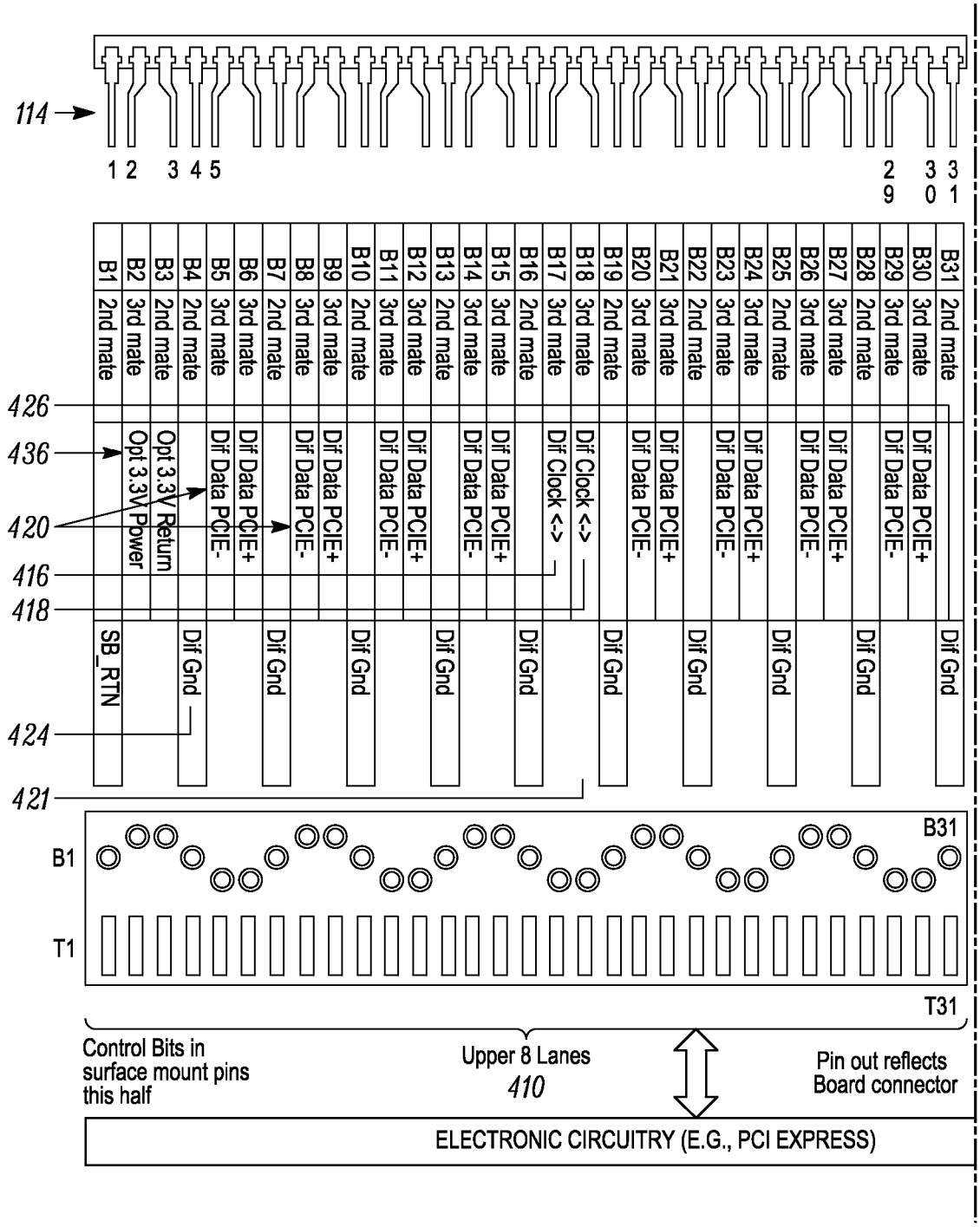
FIGS. 4 and 5 diagrammatically illustrate signaling configurations provided by the connector of FIG. 1 according to one example set forth in the disclosure.
Figure 5:
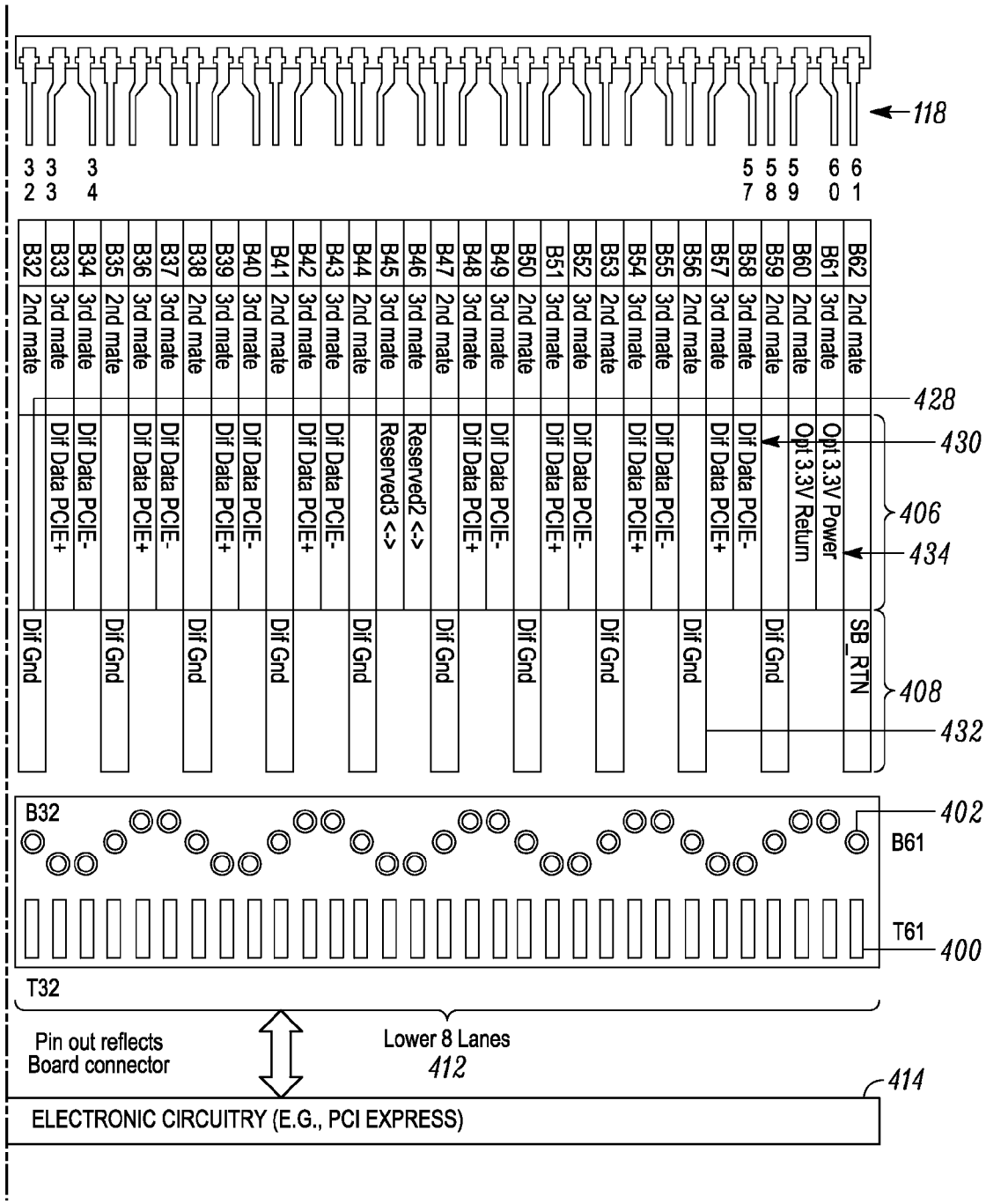

Also as shown in this example, the spacing between the surface mount pins may be, for example, 0.7 mm and the width of a surface mount pin may be, for example, 0.26 mm however any suitable spacing and width may be used. The through hole pins may have a spacing of, for example, 0.7 mm (and as shown in FIGS. 4 and 5), may be offset. In addition, the width of the through hole pins may be, for example, 0.74 mm. However, any suitable sizing may be employed as desired.

With the 16 lane PCI Express™ compatible configuration, the housing 106 is sized to provide a substrate footprint of approximately 12 mm×53 mm such that the housing may have, for example, a 12.2 mm depth and a 53.25 mm width, or any other suitably sized dimensions. For example, the depth and width may be several millimeters larger or smaller as desired. Also in this example, the rows of lower and upper contacts for both the first and second group of electrical contacts include 124 pins configured for a 16 lane PCI Express™ interface (e.g., two 8 lane differential bus links).

The connector 100 as shown may include one or more friction tabs 116 that frictionally engage a cable connector that mates with the board connector 100. Other known connector engagement features may also be employed such as openings 118 and 120 that receive protrusions that extend from a corresponding mating cable connector.

Referring again to FIG. 2, the connector 100 may include as part of the housing, insulation covering 202 and ground contacts and frictional locks 206 and 208 that frictionally engage with a mating cable connector using techniques known in the art. Supporting structures 210 are also employed to support pins in their appropriate positions within the connector using known techniques. The connector 100 includes a center support structure 212 over which the upper rows of surface mount pins 116 are supported and over which lower contacts 114 are also supported. The center support structure 212 supports the electrical contacts and in operation receives a mating connector whose contacts align with the upper and lower contacts 114 and 116 to make electrical contact.

FIGS. 4 and 5 diagrammatically illustrate a portion of a printed circuit substrate referred to as a substrate layout showing surface mount contacts 400 and through holes 402 that are positioned on a circuit substrate. The lower rows of contacts 114 and 118 are coupled to the through holes 402 to provide electrical contact and signal communication through the connector 100 to an electrical circuit or circuits on the printed circuit board. Traces or pins from an electrical circuit may be electrically coupled to the pads 400 to communication signals through the connector 100. The figure shows a pinout of the bottom row contacts of connector 100 and the electronic signals designated as 406 and 408 corresponding to respective contacts in the connector 100.

In this example, groupings of contacts form upper 8 lanes shown as 410 and a lower 8 lanes designated 412. Electronic circuitry 414, such as a PCI Express™ 16 lane interface circuit that may be integrated in a graphics processor core, CPU, bridge circuit such as a Northbridge, Southbridge, or any other suitable bridge circuit or any other suitable electronic circuit sends and receives signals identified as 406 and 408 via the connector 100. Electronic circuitry 14 is located on the electronic circuit substrate and is coupled to the first group of electrical contacts and second group of electrical contacts (shown here are only the lower contacts). The electronic circuitry 414 provides differential clock signals labeled 416 and 418 that are located in a center portion of the first group of contacts 1110. The electronic circuitry also provides a plurality of differential data pair signals generally designated as 420 on either side of a center portion 421. Corresponding differential ground signals 424 are provided between the differential signals 420. Upper contacts 116 (not shown) provide control signals associated with the differential data pair signals 420. In this example, the other group of contacts 112 does not include the differential clock signals 416 and 418. The electronic circuitry provides all of the necessary PCI Express™ type control signaling, clock signaling and power to run an 8 lane bus via the first grouping of contacts 110. 16 lanes may be accommodated by providing the signaling as shown. This incorporates utilizing the second group of contacts 112.

As also shown, the first group of electrical contacts 110 and second group of electrical contacts 112 are divided by adjacent ground contacts designated 426 and 428. The second group of contacts 112 are coupled such that the second row of lower contacts include a plurality of differential data signals 430 that are provided on adjacent pins separated by corresponding differential ground signals 432 and power is provided on an outer pin portion designated as 434 to a second row of lower contacts. Similarly, power is provided on an outer portion of the connector corresponding to the first group of contacts 114 shown as power signals 436. In this example, the electronic circuitry 414 includes differential multilane bus transceivers that are PCI Express™ compliant, as known in the art. However, any suitable circuitry may be coupled to the connector 100 as desired. As also shown, the first and second group of contacts 110 and 112 each include the end grounding contact 426 and 428 that are positioned adjacent to each other and substantially in the center of the housing.

In addition, the first and second groups of electrical contacts include sensing contacts positioned at an outer end of a row of contacts to determine proper connector insertion on both ends of the cable. In addition, the connector also includes a power control pin that can be used in conjunction with the sensing contacts to control power sequencing and other functions between the two connected systems.

FIG. 6 illustrates one example of a cable having a cable end connector 500 that is configured to matingly engage with the connector 100. The cable 502 includes an end connector on either end thereof (although not shown) that are identical to the end connector 500 and the connector end 500 is adapted to mate with the divided multi-connector element 108. As such, the cable end connector 500 also includes a male portion 504 that engages with the contacts via center portion 212 of connector 100. As known in the art, the end connector may be made of any suitable materials including plastic and metal to provide the necessary structural, shielding and grounding characteristics as desired. The male portion 504 is adapted to frictionally engage with the friction tabs 116 of the board connector 100. The cable 502 may be made of two groups of wires each forming an 8 lane grouping. However, any suitable configuration may be used.

FIGS. 7-14 are diagrams illustrating electrical signals that are provided by the electrical circuitry 414 through connector 100 in one device and corresponding electrical circuitry that is in another device that is connected via the cable connector 502. As such, a host device (referred to as host side), such as a laptop computer or any other suitable device is connected via a cable to a downstream device via a connector 100 and the downstream device also contains the connector 100. As such, a simplified connector/cable pairing is suitably provided with high speed data communication capability. As illustrated, the connector 100 is operatively coupled to electronic circuitry to provide the signals on the pins as shown. As a point of reference, a portion of FIGS. 4 and 5 showing the signals is duplicated in FIGS. 7-14 shown by arrow 600. The top row of contacts 116 and 120 are shown by the portion labeled 602. As shown, the bottom rows of contacts 114 and 118 are primarily coupled between differential transmitters of for example a graphics processor (downstream device) and differential receivers of the host device whereas the top rows 116 and 120 of connector 100 are coupled between receivers of the graphics processor located in a downstream device and differential transmitters of a host device.

In the host device, the corresponding lower rows 114 and 118 shown as 604 are provided as shown. For example, a top row 116 and 120 on a host side device shown as signals 606 are provided by suitable electronic circuitry. In this example, the circuitry as noted above includes PCI Express™ compliant interface circuitry that provides in this example 16 lanes of information. The total number of pins used in this example is 124 pins. As such, this reflects a signal and pinout for a 16 lane to 16 lane connection.

FIGS. 15-18 illustrate instead, a signal and pinout configuration for an 8 lane to 8 lane connection using instead of a 16 lane sized connector, an 8 lane size connector. However, the identical signals are provided on the identical pins of the 8 pin connector as are provided on the first group of connectors 110 of the 16 lane connector. As such, an 8 lane connector may be employed that is similar in design to the connector shown in 100 except that half of the pins are used resulting in a housing that is sized to provide a footprint of approximately 12 mm×32 mm and a profile of approximately 32 mm×6 mm and includes a total of 68 pins configured in a row of lower contacts and upper contacts. As such, FIGS. 15-18 illustrate a host side connector 702 that is connected with a downstream device connector 704 via an 8 lane cable 706.

FIGS. 19-24 illustrate yet another configuration that employs pinout and signaling wherein a first device such as a host device employs an 8 lane connector with signaling shown as 702 with a cable that at another end includes the connector 100 with the pinout and signaling shown as 600 and 602. As such, an 8-16 lane connector configuration may be used wherein only 8 lanes of the 16 lane connector are actually coupled to circuitry. In this manner, existing 16 lane connectors may be readily coupled to devices that employ 8 lane connectors if desired.

Figure 25:
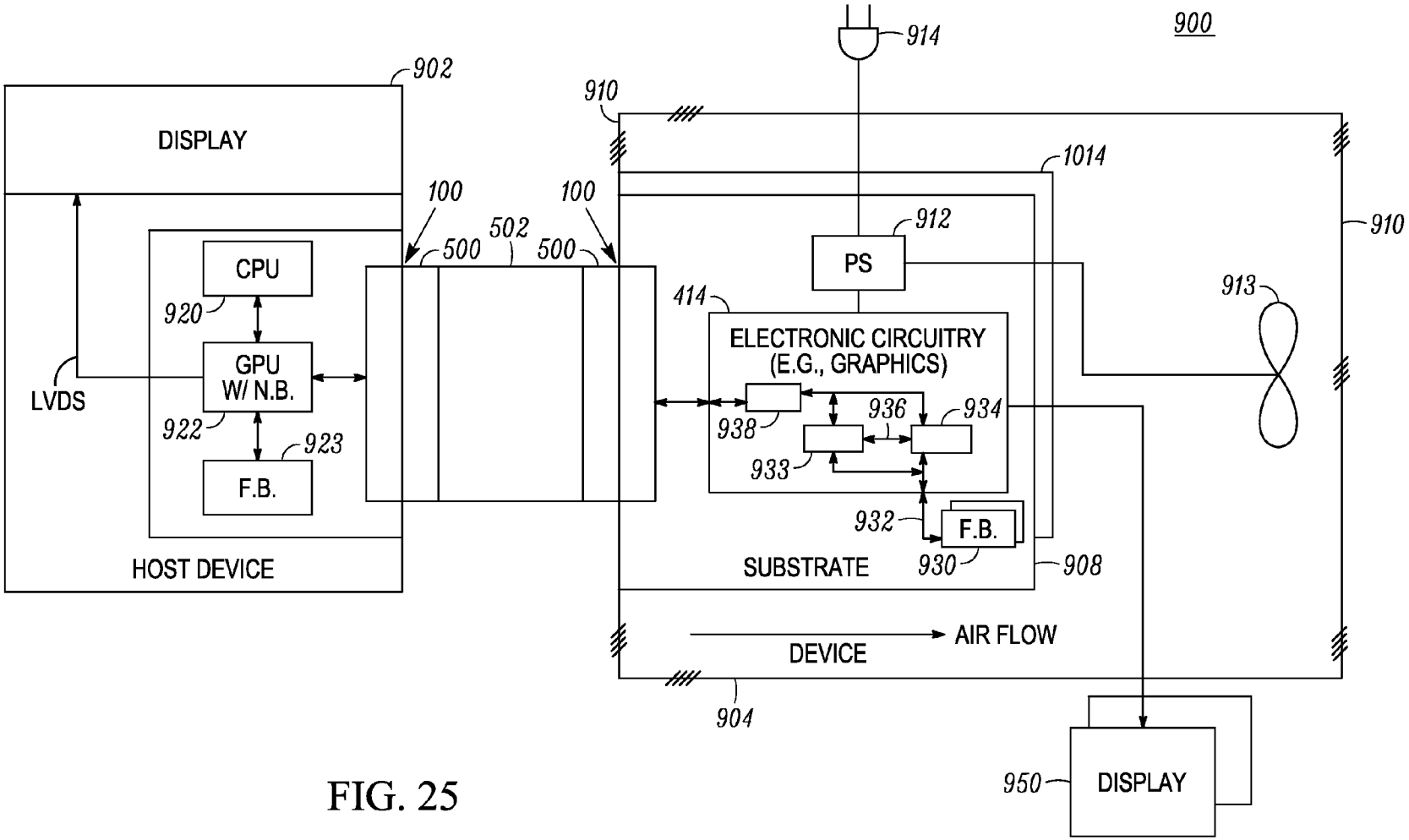
FIG. 25 diagrammatically illustrates a system employing the board connector of FIG. 1 in accordance with one example set forth in the disclosure.

FIG. 25 illustrates one example of a system 900 that employs a first device 902, such as a host device such as a laptop, desktop computer or any other suitable device and a second device 904 such as a device employing an electronic circuit that includes electronic circuitry 414 operatively mounted to substrate 908 such as a printed circuit board that contains connector 100. The electronic circuitry 414 may be, for example, a graphics processor or any other suitable circuitry and in this example includes PCI Express™ compliant transceiver circuitry to communicate with the host device 902 via the cable and connector structure described herein. The device 904 which may include, for example, a housing that includes grates that serve as air passages 910 that provide air flow for cooling the electronic circuitry and may also include an active cooling mechanism such as a fan 913 although suitably controlled to provide cooling via air flow, as known in the art. The substrate 908 may include a power supply circuit 912 that provides a suitable power for all electronic circuitry and may receive alternating current (AC) from an outlet through plug 914. The host device may include as known, one or more central processing units 920 and one or more graphics processors 922 in addition to suitable memory, operating system software and any other suitable components, software, firmware as known in the art. As such, in this example, the device 904 may receive drawing commands from the CPU 920 and/or GPU 922 via the differential signaling provided through the connectors 100 and cabling 502 to provide off device graphic processing enhancement through a suitable connector arrangement that is consumer friendly, relatively low cost and provides the data rates required for a high data rate video, audio and graphics processing.

The electronic circuitry 414 as noted above may include graphics processing circuitry such as graphics processor core or cores, one or more CPUs, or any other suitable circuitry as desired. As shown, in the case that the electronic circuitry includes graphics processing circuitry, one or more frame buffers 930 are accessible by the graphics processing circuitry through one or more suitable buses 932 as known in the art. Also, in another embodiment, where a single circuit substrate 908 is used, the electronic circuitry 414 ma include a plurality of graphics processing circuitry such as a plurality of graphics processors 932 and 934 that are operatively coupled via a suitable bus 936 and may be connected with the divided multi-connector element differential bus connector 100 via a bus bridge circuit 938 such as a PCI bridge, or any other suitable bus bridge circuit. The bus bridge circuit provides information to and from the connector 100 and also switches communication paths between the connector 100 and each of the graphics processors 932 and 936 as known in the art. As such, in this example, a plurality of graphics processors, for example, can provide parallel or alternate graphics processing operations for the host device 902 or other suitable device.

The above detailed description of the invention and the examples described therein have been presented for the purposes of illustration and description only and not by limitation. For example, the board connector may include a first ground plate configured with a first plurality of protruding pins and positioned between the lower contacts and the upper contacts, a second and separate ground plate of a same shape and size to the first ground plate and configured with a second plurality of protruding pins and positioned between the corresponding lower contacts and the upper contacts to provide grounding. It is therefore contemplated that the present invention cover any and all modifications, variations or equivalents that fall within the spirit and scope of the basic underlying principles disclosed above and claimed herein.

What is claimed is:

1. An electrical connector comprising:

a housing;

a divided multi-connector element in the housing comprising:

an electrical contact configuration comprised of a first group of electrical contacts divided from an adjacent second group of contacts, the first group of electrical contacts comprising a row of lower contacts comprised of thru hole pins with a pattern of different length pins and upper contacts comprised of surface mount pins; and the second group of electrical contacts having a mirrored configuration corresponding to the row of lower contacts and upper contacts of the first group of electrical contacts.

2. The electrical connector of claim 1 wherein each of the first and second group of contacts comprise an end grounding contact wherein the respective end grounding contacts are positioned adjacent to each other substantially in the center of the housing.

3. The electrical connector of claim 1 wherein each of the first and second group of electrical contacts comprises sensing contacts positioned at an outer end of a row of contacts.

4. The electrical connector of claim 1 wherein the housing is sized to provide a footprint of approximately 12 mm ×53 mm and a profile of approximately 53 mm ×6 mm.

5. The electrical connector of claim 4 wherein the rows of lower and upper contacts for both the first and second group of electrical contacts comprise 124 pins configured for two 8 lane differential buses.

6. An electronic device comprising:

an electronic circuit substrate;

an electrical connector operatively coupled to the electronic circuit substrate, comprising:

a housing;

a multi-connector element in the housing comprising:

a divided electrical contact configuration comprised of a first group of electrical contacts divided from an adjacent and second group of contacts, the first group of electrical contacts comprising a first row of lower contacts and upper contacts; and the second group of electrical contacts having a mirrored configuration as the first group of electrical contacts comprising corresponding second row of lower contacts and upper contacts;

electronic circuitry located on the electronic circuit substrate and operatively coupled to the first group of electrical contacts divided from an adjacent second group of contacts wherein the row of lower contacts is coupled to the electronic circuitry to provide differential clock signals in a center portion thereof and a plurality of differential data pair signals on either side of the center portion thereof, and wherein the first row of upper contacts provide control signals associated with the differential data pair signals.

7. The electronic device of claim 6 wherein the electronic circuitry is comprised of a differential multilane bus transceiver.

8. The electronic device of claim 6 wherein each of the first and second group of contacts comprise an end grounding contact wherein the respective end grounding contacts are positioned adjacent to each other substantially in the center of the housing.

9. The electronic device of claim 6 wherein each of the first and second group of electrical contacts comprises sensing contacts positioned at an outer end of a row of contacts.

10. The electronic device of claim 6 comprising a cable having a first end connector and a second end connector wherein each end connector is identical and wherein each end connector is adapted to mate with the divided multi-connector element.

11. The electronic device of claim 6 comprising a cable having a first end connector and a second end connector wherein the second end connector is adapted to electrically mate with only the first group of electrical contacts and not the second group of electrical contacts.

12. The electronic device of claim 6 wherein the first group of electrical contacts and the second group of electrical contacts are divided by adjacent ground contacts.

13. The electronic device of claim 12 wherein the second group of contacts is coupled such that the second row of lower contacts comprises a plurality of differential data signals that are provided on adjacent pins separated by differential ground signals and wherein power is provided on an outer pin portion of the second row of lower contacts.

14. The electronic device of claim 13 wherein the rows of upper contacts are comprised of surface mount pins and wherein the rows of lower contacts are comprised of thru hole pins and wherein the connector further comprise mating connector presence pins operative to provide a signal in response to proper connection with a cable having a mating connector end.

15. The electronic device of claim 6 wherein the housing of the electrical connector is sized to provide a footprint of approximately 12 mm ×53 mm and a profile of approximately 53 mm ×6 mm.

16. The electronic device of claim 15 wherein the rows of lower and upper contacts for both the first and second group of electrical contacts comprise 124 pins configured for two 8 lane differential buses.

17. An electronic device comprising:

an electronic circuit substrate;

an electrical connector operatively coupled to the electronic circuit substrate, comprising:

a housing comprising therein:

a first row of lower contacts and upper contacts, wherein the row of upper contacts is comprised of surface mount pins and wherein the row of lower contacts is comprised of thru hole pins;

electronic circuitry located on the electronic circuit substrate and operatively coupled to the contacts such that the first row of lower contacts is coupled to provide differential clock signals in a center portion thereof and a plurality of differential data pair signals one either side of the center portion thereof, and wherein the first row of upper contacts provide control signals associated with the differential data pair signals.

* * * * *